US008770627B2

(12) United States Patent
Beretta

(10) Patent No.: US 8,770,627 B2
(45) Date of Patent: Jul. 8, 2014

(54) PRODUCT SECURITY PATTERN BASED ON SIMULTANEOUS COLOR CONTRAST

(75) Inventor: Giordano Beretta, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2219 days.

(21) Appl. No.: 11/280,897

(22) Filed: Nov. 16, 2005

(65) Prior Publication Data

US 2007/0110271 A1 May 17, 2007

(51) Int. Cl.
*B42D 15/00* (2006.01)

(52) U.S. Cl.
USPC ..... 283/114; 283/81

(58) Field of Classification Search
USPC ..... 283/72, 89, 114
See application file for complete search history.

(56) References Cited

U.S. PATENT DOCUMENTS

| | | | | |
|---|---|---|---|---|
| 1,612,791 | A * | 12/1926 | Ames et al. | 356/422 |
| 3,752,073 | A * | 8/1973 | Lorber | 101/211 |
| 4,820,163 | A * | 4/1989 | McCarty | 434/81 |
| 5,473,439 | A | 12/1995 | Pappas | |
| 5,670,005 | A * | 9/1997 | Look et al. | 156/236 |
| 5,995,638 | A | 11/1999 | Amidror et al. | |
| 6,198,545 | B1 | 3/2001 | Ostromoukhov et al. | |
| 6,249,588 | B1 | 6/2001 | Amidror et al. | |
| 6,819,775 | B2 | 11/2004 | Amidror et al. | |
| 7,180,524 | B1 * | 2/2007 | Axelrod | 345/593 |
| 2002/0030360 | A1 * | 3/2002 | Herrmann et al. | 283/72 |
| 2003/0021437 | A1 | 1/2003 | Hersch et al. | |
| 2003/0026500 | A1 | 2/2003 | Hersch et al. | |
| 2003/0043424 | A1 * | 3/2003 | Bhaskar et al. | 358/518 |
| 2003/0161017 | A1 * | 8/2003 | Hudson et al. | 359/2 |
| 2004/0076310 | A1 | 4/2004 | Hersch et al. | |
| 2004/0233463 | A1 | 11/2004 | Hersch et al. | |
| 2005/0052705 | A1 | 3/2005 | Hersch et al. | |

FOREIGN PATENT DOCUMENTS

| | | | |
|---|---|---|---|
| EP | 1 073 257 | A1 | 1/2001 |
| FR | 2 838 201 | A1 | 10/2003 |

OTHER PUBLICATIONS

The Art of Color (w/ interior example pages) http://www.amazon.com/The-Art-Color-Subjective-Experience/dp/0442240376/ref=sr_1_1?ie=UTF8&qid=1375752084&sr=8-1&keywords=art+of+color.*

Rudaz et al., "Protecting identity documents with a just noticeable microstructure," SPIE vol. 4677, pp. 101-109 (2002).

Josef Albers, "Interaction of Color," ISBN 0-300-01846-0, pp. 19-20 (1971).

Hope et al., "The color compendium," ISBN 0-442-31845-6, pp. 273-274 (1990).

Rolf G. Kuehni, "Color, an introduction to practice and principles," ISBN 0-471-14566-1, pp. 47-49 (1997).

Colorcube: "Simultaneous Contrast, Induction"; retrieved from: www.colorcube.com/illusions/scindctn.htm; Jun. 18, 2007.

* cited by examiner

*Primary Examiner* — Kyle Grabowski

(57) ABSTRACT

A product package article has an HVS-perceivable security pattern on its surface. The security pattern is based on simultaneous color contrast. The security pattern can provide protection against counterfeiting.

11 Claims, 6 Drawing Sheets

PRODUCT SECURITY PATTERN BASED ON SIMULTANEOUS COLOR CONTRAST

BACKGROUND

Counterfeiting poses a serious problem to the pharmaceutical industry. Counterfeit drugs can lead to lost revenues, increased liability, and brand erosion. Product recalls due to counterfeit warnings are expensive and disruptive.

Counterfeit drugs also pose a serious problem to the public. Counterfeit drugs might contain the wrong ingredient, lack an active ingredient, or be of poor quality. Deaths and hospitalizations have occurred due to counterfeit drugs that were contaminated with bacteria.

Counterfeiting is not limited to the pharmaceutical industry. Other industries—cosmetics, electronics, software, automotive and aircraft, to name a few—also have to deal with counterfeit products.

Overt measures to deter counterfeiting include marking products with distinct colors and patterns, holograms, recto/verso registration, and visible watermarks. Covert measures include marking products with invisible marks and machine readable code, fluorescent and magnetic inks, hidden patterns, encrypted codes, radio frequency identification, engravements, and micro-displacement of glyphs.

Most of these measures add complexity or cost (or both) to product manufacture. In addition, detection can be difficult and slow. Detection using some of these measures involves specialized equipment.

An inexpensive anti-counterfeiting measure is desirable. Quick and simple detection is also desirable.

SUMMARY

According to one aspect of the present invention, a product package article comprises an HVS-perceivable security pattern on a surface of the article. The security pattern is based on simultaneous color contrast.

According to another aspect of the present invention, a method of protecting a product against counterfeiting includes adding first and second security patterns to package articles of the product. The security patterns have backgrounds of different colors and foreground objects of the same color. The foreground and background colors of each pattern have different contrast levels to create an illusion that the foreground objects have different colors.

Other aspects and advantages of the present invention will become apparent from the following detailed description, taken in conjunction with the accompanying drawings, illustrating by way of example the principles of the present invention.

DETAILED DESCRIPTION

Figure 1:
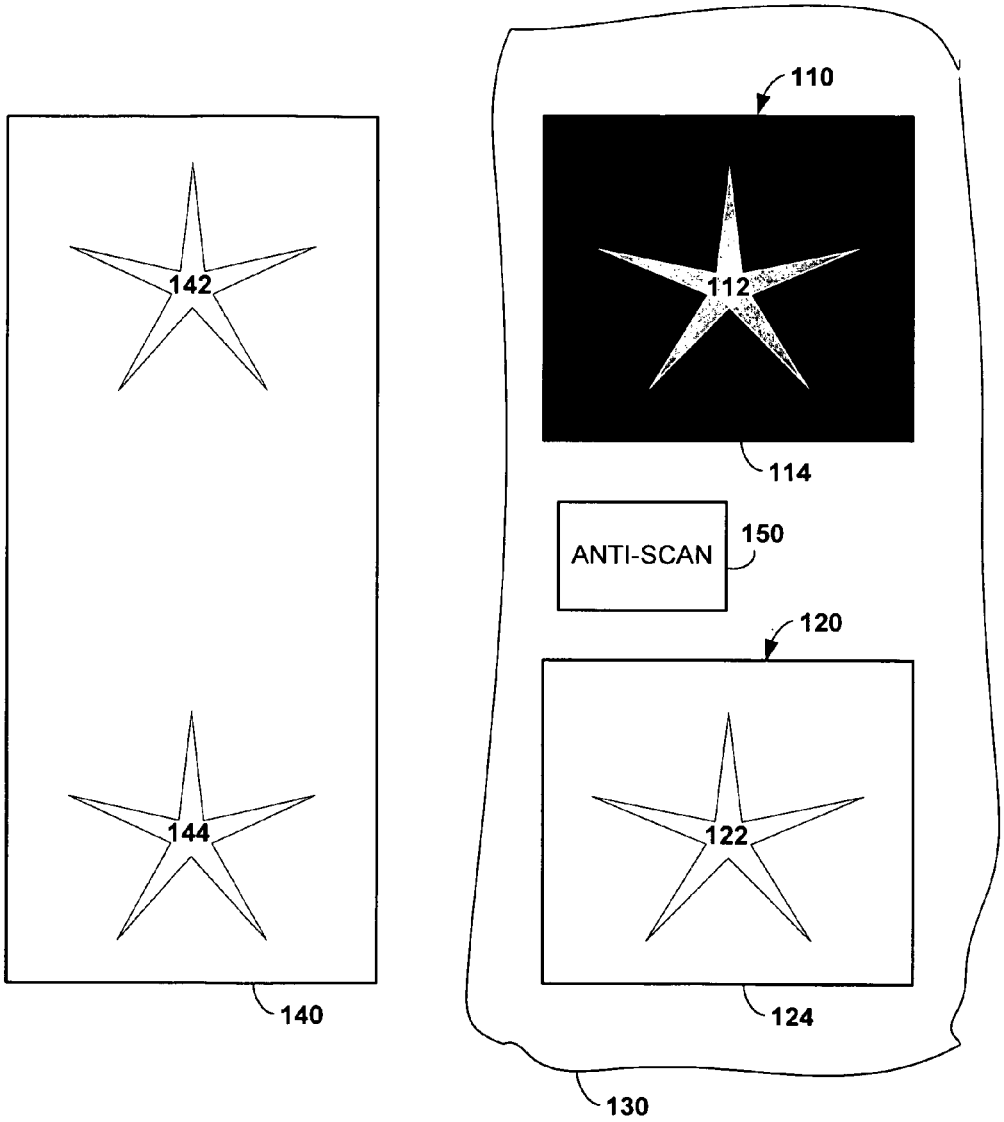
FIG. 1 is an illustration of a product package article with security patterns in accordance with an embodiment of the present invention.

As shown in the drawings for purposes of illustration, the present invention is embodied in security patterns for product package articles. The security patterns are based on simultaneous color contrast. Certain objects in these patterns, when perceived by the human visual system (HVS), appear to have different colors. In reality, however, the objects have the same color. The colors are perceived to be different because the security patterns exploit interactions between contrasting colors. When perceived by the human visual system, the mutual influence of two adjacent colors cause each to enhance or reduce the other's saturation and even substantially alter their respective hues. Two contrasting colors together will make each other appear more saturated and vivid. The effect of simultaneous color contrast is greatest at the edges between colors, or on patterns of a small scale. This visual phenomenon is also known as color irradiation.

For the purposes herein, achromatic colors white, gray and black are considered to be colors.

Reference is made to FIG. 1, which illustrates a simple example of first and second security patterns 110 and 120 based on simultaneous color contrast. The first security pattern includes a light gray star 112 (e.g., 10% black or RGB=[230,230,230] for red, green and blue coordinates scaled from 0 to 255) against a black background 114 (RGB=[0,0,0]). The second security pattern 120 includes a light gray star 122 (RGB=[230,230,230]) against a white background 124 (RGB=[255,255,255]). Due to reproduction quality of the drawings, a person viewing FIG. 1 might not perceive a difference in the color of the stars 112 and 122. In a higher quality print, however, a counterfeiter would perceive slightly different colors of the stars 112 and 122 due to simultaneous color contrast: the star 112 would appear white because the black background 114 makes it look lighter, while the star 122 would appear darker due to the white background 124. Thus, these contrasting foreground and background colors create an illusion that the stars 112 and 112 have different colors. Consequently a counterfeiter would reproduce the patterns 110 and 120 with a white star and a gray star.

Although grayscale values can be used for the security patterns 110 and 120, the perceived differences are greater for contrasting colors having chrominance components. Simultaneous color contrast can be strongest when the foreground color in one pattern is complementary and the foreground color in the other pattern has the same hue.

As a first example, the first security pattern 110 has a gray background of RGB=[146, 147,149], and the second security pattern 120 has a yellowish background of RGB=[198,192, 125]. The foreground objects 112 and 122 in the first and second security patterns 110 and 120 both have a color of RGB=[171,169,141].

As a second example, the first security pattern 110 has a gray background of RGB=[146, 147,149], and the second security pattern 120 has a pinkish background of RGB=[217, 137,163]. The foreground objects 112 and 122 in the first and second security pattern 110 and 120 both have a color of RGB=[171,141,151].

As a third example, the first security pattern 110 has a gray background of RGB=[146, 147,149], and the second security pattern 120 has a bluish background of RGB=[125,149,198]. The foreground objects 112 and 122 in the first and second security pattern 110 and 120 both have a color of RGB=[141, 151,171].

As a fourth example, the first security pattern 110 has a gray background of RGB=[146, 147,149], and the second security pattern 120 has a greenish background of RGB=[180,198,125]. The foreground objects 112 and 122 in the first and second security pattern 110 and 120 both have a color of RGB=[163, 171,141].

The security patterns 110 and 120 are printed on a product package article 130. The product package article 130 is not limited to any particular type. Exemplary types of product package articles 130 include, without limitation, labels, test strips, substrates, package inserts, envelopes, boxes, cartons, pallets, containers, and wrappers. Security patterns could be added to more than one of these articles. In some embodiments, the articles could provide the backgrounds.

In these examples, only first and second security patterns 112 and 122 are described. However, more than two security patterns based on simultaneous color contrast may be used.

FIG. 1 also illustrates a tool 140 for determining whether the security patterns 110 and 120 are genuine or counterfeit. The tool 140 can be a template having the same color as the foreground objects 112 and 122 (e.g., RGB=[230,230,230]). The template has cutouts 142 and 144. When the tool 140 is placed over the security patterns 110 and 120, the cutouts 142 and 144 expose only the foreground objects 112 and 122. As a result, the foreground objects 112 and 122 are perceived without influence from the backgrounds 114 and 124. If the foreground objects 112 and 122 are genuine, the colors of the exposed foreground objects 112 and 122 will match the template. A mismatch indicates a counterfeit product.

The tool 140 can be distributed along with products package article 130. For example, the tool 140 can be included with the product package article 130 (e.g., enclosed in a box), placed in the store display, or provided separately to stores and distributors.

The security patterns 112 and 122 and the product package article 130 may contain other sets of foreground objects. However, only the correct set of foreground objects 112 and 122 is exposed by the tool 140.

Figure 2:
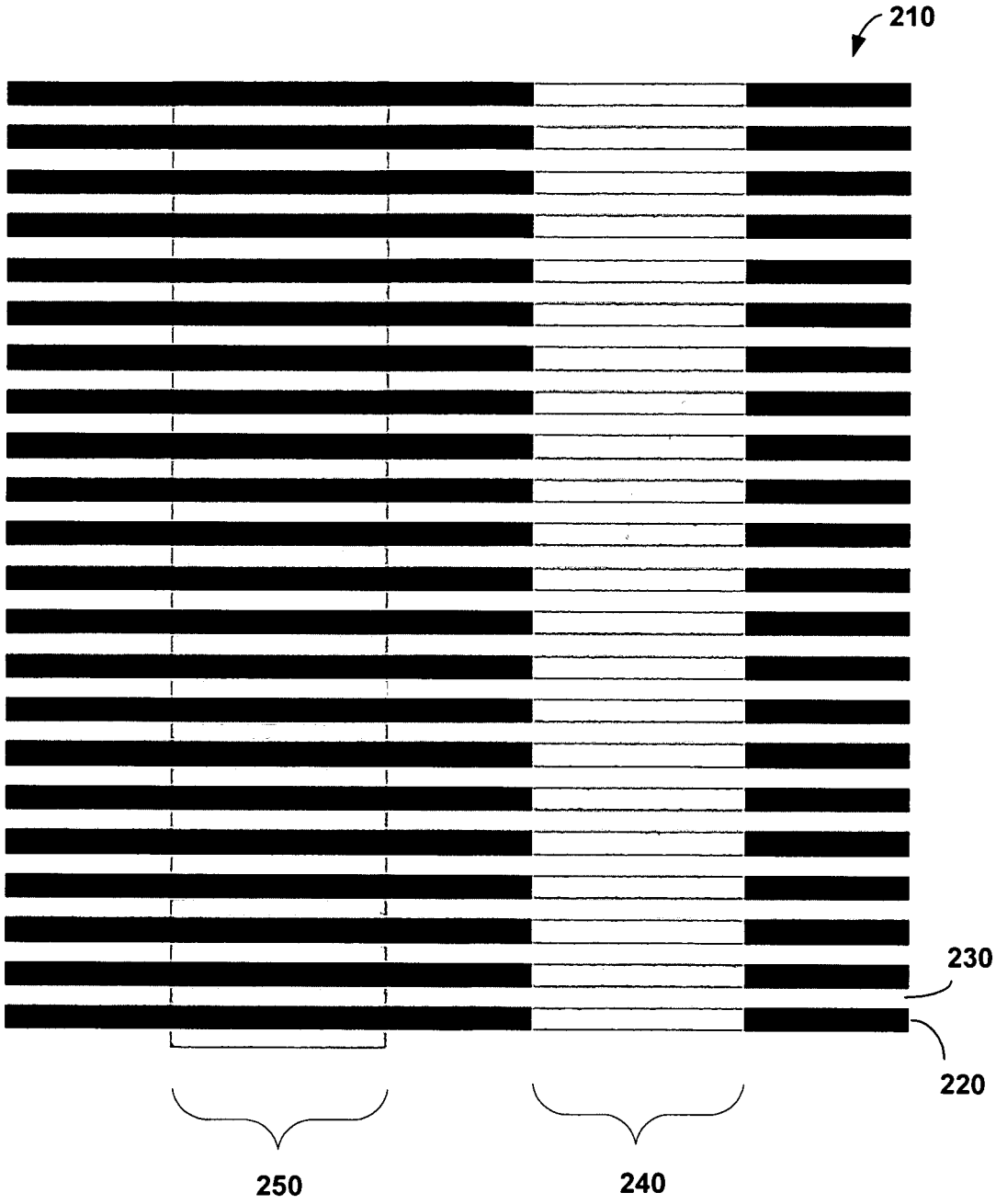
FIG. 2 is an illustration of security patterns in accordance with another embodiment of the present invention.

In some embodiments, security patterns according to the present invention can be formed by adjacent foreground objects having contrasting colors (instead of foreground objects against backgrounds having contrasting colors). An example of such a security pattern is illustrated in FIG. 2. The exemplary security pattern of FIG. 2 only shows grayscale patterns. In practice, contrasting colors having chrominance components may be used.

Referring now to FIG. 2, this exemplary security pattern 210 includes horizontal elongated bars 220 and 230 that alternate between dark and light colors. Each dark bar 220 may be colored black (RGB=[0,0,0]) except for a gray portion (e.g., RGB=[170,170,170]). The gray portions of the dark bars 220 are aligned in a right column, referenced by numeral 240. Each light bar 230 may be colored white (RGB=[255,255,255]) except for a gray portion. The gray portions of the light bars 230 have the same shade as the gray portions of the dark bars 220 (e.g., RGB=[170,170,170]). The gray portions of the light bars 230 are aligned in a left column, referenced by numeral 250. To a counterfeiter, the gray portions of the left columns 250 would appear darker than the gray portions of the right columns 240.

Yet during detection, a tool (e.g., a stripe) of the same gray (e.g., RGB=[170,170,170]) color, covering the area between columns 240 and 250, would indicate that all gray portions in both columns 240 and 250 have the same shade of gray. During detection, a tool would cover only the correct set of foreground objects.

Security patterns according to the present invention are not limited to any particular geometric shape or pattern. However, features of a security pattern (e.g., the foreground objects) may be made small enough so they cannot be measured with a device (e.g., a spectrophotometer or spectroradiometer) ordinarily used in graphic arts and print shops. For example, the features may be smaller than 3.5 mm.

Security patterns may be placed at different locations on a package article. For example, security patterns may be spaced apart on an insert, placed on different sides of a carton, placed on different packages, etc.

An anti-scan pattern may be added to the product package article, over or near the security patterns (see, for example, element 150 in FIG. 1). The anti-scan pattern is not perceivable by the human visual system. When scanned, however, the anti-scan pattern could create a Moiré pattern or some other pattern that degrades the quality of the scanned security pattern. The anti-scan pattern might fall apart or break down when scanned. The anti-scan pattern might create a watermark (e.g., "COUNTERFEIT") to appear across the scanned image. Such a watermark is not perceivable to the human visual system, becomes visible when scanned.

The anti-scan pattern prevents a counterfeiter from scanning the security patterns and printing out and using the scanned version. It forces the counterfeiter to rely on a visual analysis of the security patterns. Due to the simultaneous color contrast, the visual analysis will produce patterns having incorrect colors.

Conventional security measures could also be added to the product package article. Examples of conventional measures include, without limitation, lot numbers, use of specialty inks (e.g., fluorescent, metallic, magnetic inks), color coding, holograms and optically varying devices, digital watermarks, encoded bar codes, registration or placement encoding, microtext, and distinct patterns, character sets, perforations, and images. These added measures can further enhance security.

Security can be further enhanced by changing the security measures from product-to-product, product batch-to-batch, print run-to-print run, etc. Collectively, the measures might not stop all counterfeiting, but at least they will increase the difficulty of counterfeiting.

Thus disclosed is an anti-counterfeiting measure that does not add complexity or cost to product manufacture. Detection is fast and simple, and does not require specialized equipment.

The security patterns are not limited to any particular products. Examples of products include pharmaceuticals, cigarettes, optical disks, electronic components, and printer ink cartridges.

Figure 3:
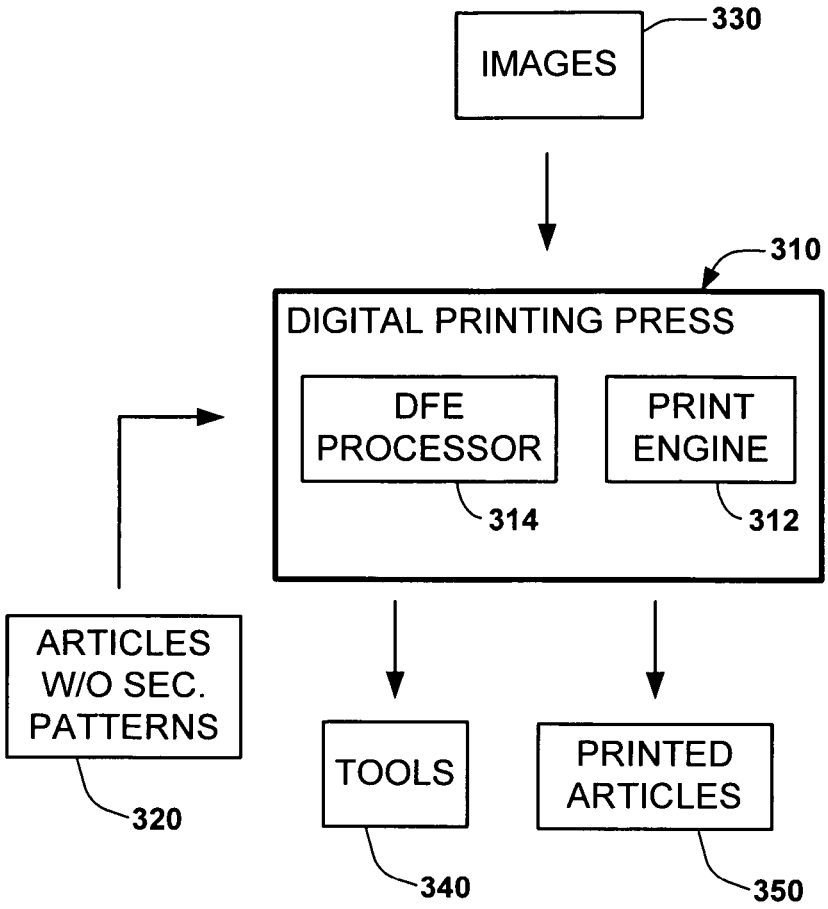
FIGS. 3 and 4 are illustrations of an anti-counterfeiting system and method in accordance with an embodiment of the present invention.
Figure 4:
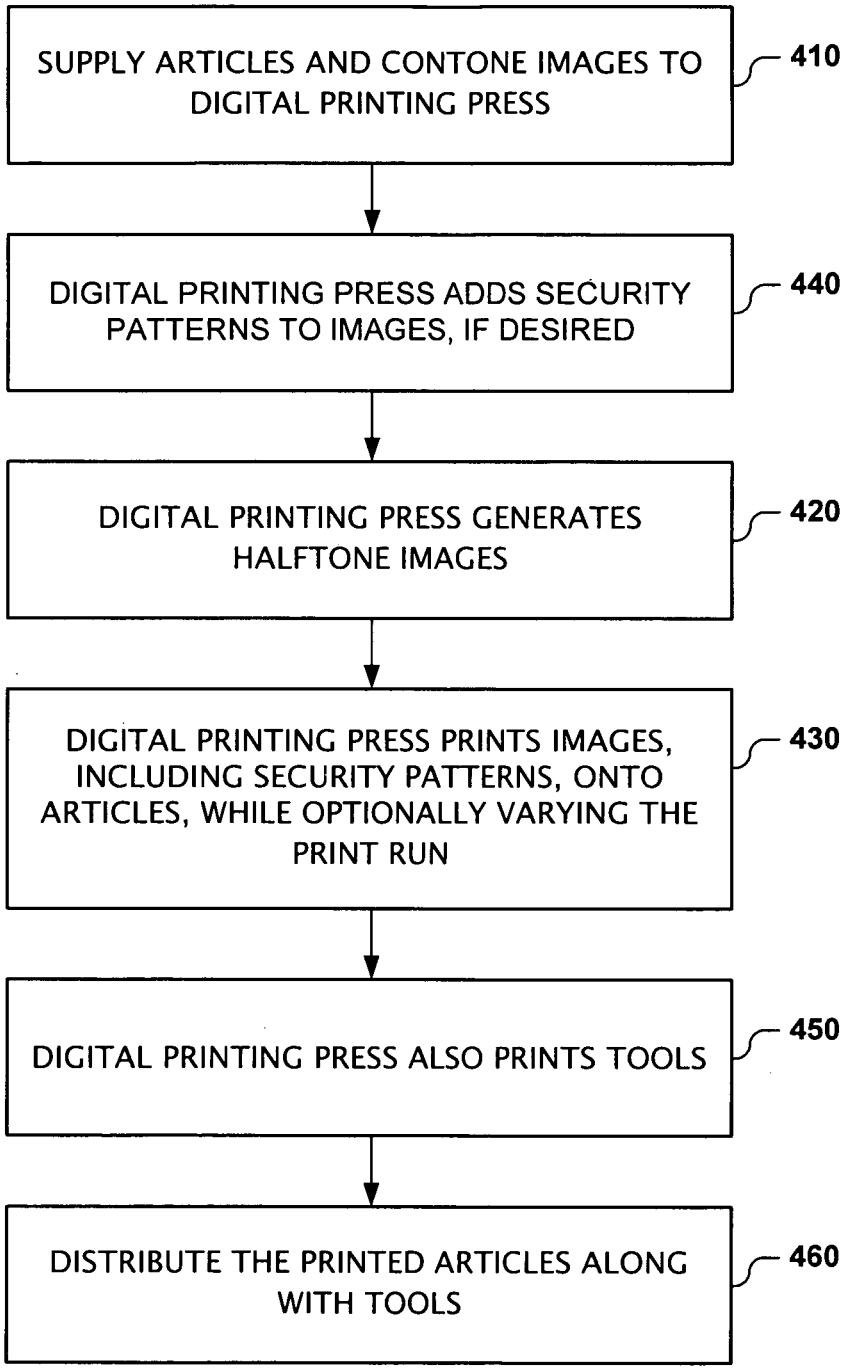

Reference is now made to FIGS. 3-4, which illustrate a system and method of protecting products against counterfeiting. The system includes a digital printing press 310 having a print engine 312 and a digital front-end processor 314.

Product package articles 320 without security patterns are supplied to the print engine 312 of the digital printing press 310 (block 410). A continuous tone (contone) image or set of contone images 330 are supplied to the digital front-end processor 314 of the digital printing press 310 (block 410). The images may be, for example, images of product labels. The images may also include images of tools for the security patterns.

The digital front-end processor 314 halftones each contone image (block 420), and sends each halftone image to the print engine 312. The print engine 312 prints the images, including the security patterns, on the product package articles 320 (block 430).

The contone images 330 may include security patterns based on simultaneous color contrast. If they do not, the digital front-end processor can add security patterns to the images, before or after halftoning (block 440). Even if the contone images 330 have security patterns based on simultaneous color contrast, the digital printing press 310 can add other security patterns based on simultaneous color contrast. The digital printing press 310 can also add security measures such as anti-scan patterns.

The digital printing press 310 has the ability to vary the print run (block 430). Every article off the digital printing press 310 can have a different security pattern. As a result, the digital printing press 310 can produce sequences of patterns. This increases product security.

The digital printing press 310 can also print tools 340 for the security pattern (block 450). The tools 340 can be distributed along with the printed product package articles 350 (block 460). For instance, the tools 340 can be inserted into packages or distributed separately.

A system according to the present invention is not limited to a digital printing press. Large print runs can be printed by analog printing presses. However, digital printing presses offer a particular advantage in that prints within the same run can be varied.

Figure 5:
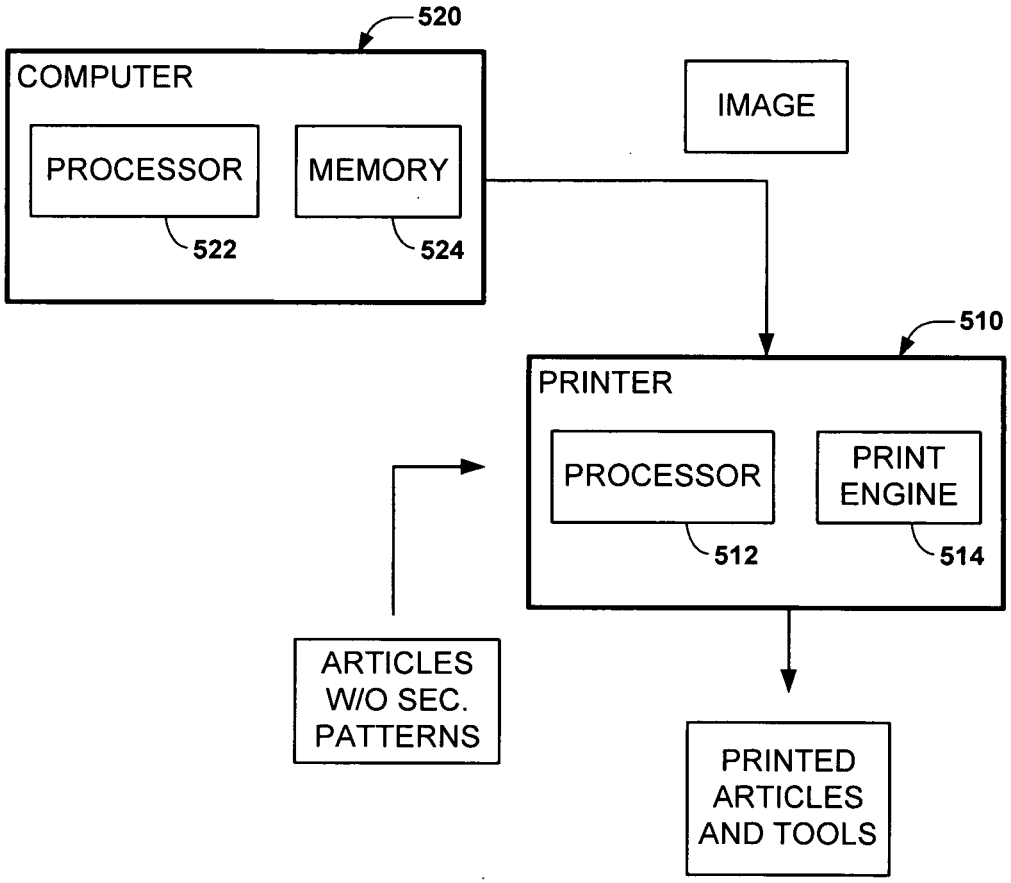
FIGS. 5 and 6 are illustrations of an anti-counterfeiting system and method in accordance with another embodiment of the present invention.
Figure 6:
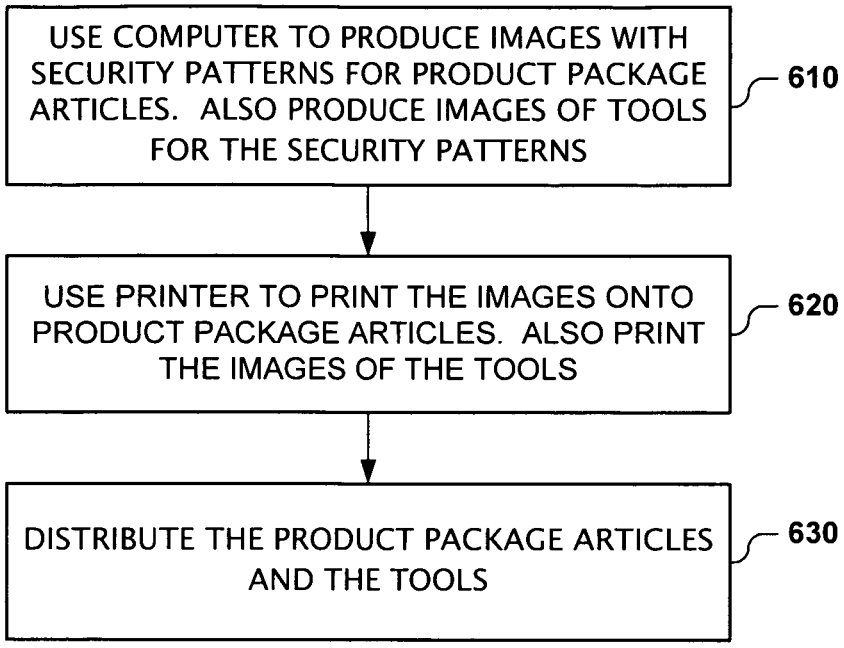

Reference is now made to FIGS. 5-6, which illustrate another system and method of protecting products against counterfeiting. A printer 510 includes a processor 512 and print engine 514. Examples of a printer 510 include, without limitation, a laser printer, a thermal ink printer, and an ink jet printer.

The printer 510 should have the ability to print features at a size that can't be analyzed by a spectrophotometer. The printer 510 should also be able to produce spot colors consistently. If the printer 510 is tightly calibrated (e.g., a thermal ink printer), there is no additional cost to printing the security patterns. In a less stable printer, custom ink plates can be used to reproduce spot colors (e.g., spot colors simulated with process colors, which is usually the case for desktop printers).

A computer 520 includes a processor 522 and memory 524 for accessing and generating contone images (block 610). The contone images may already include security patterns based on simultaneous color contrast, or the computer 520 may add such security patterns to the contone images. In addition, the computer 520 may add anti-scan patterns and other security measures. The images may also include images of tools for the security patterns. The computer 520 converts (e.g., halftones) the contone images into images that can be rendered by the printer 510.

The printer 510 prints the images onto product package articles (block 620). The printer also prints the tools. The printed articles and the tools are then distributed (block 630).

Although specific embodiments of the present invention have been described and illustrated, the present invention is not limited to the specific forms or arrangements of parts so described and illustrated. Instead, the present invention is construed according to the following claims.

The invention claimed is:

1. A product package article comprising a first HVS-perceivable security pattern applied onto a surface of the article and a second HVS-perceivable security pattern applied onto a surface of the article, wherein the first and second HVS perceivable security patterns are based on simultaneous color contrast, wherein the first and second security patterns have backgrounds of different colors and foreground objects of the same color to increase simultaneous color contrast effects, where the foreground and background colors of each security pattern have different contrast levels to create an illusion that the foreground objects are of different colors; and an anti-scan pattern applied onto the surface of the article, wherein the anti-scan pattern is not perceivable by the HVS.

2. The article of claim 1, wherein the security patterns are human visual system (HVS) security patterns.

3. The article of claim 1, wherein foreground features of the security pattern are smaller than 3.5 mm.

4. The article of claim 1, wherein the security patterns are spaced apart on the surface of the article.

5. The article of claim 1, wherein more than two security patterns are on the surface of the article.

6. A product package article comprising a first HVS-perceivable security pattern applied on a surface of the article and a second HVS-perceivable security pattern applied on a surface of the article, wherein the first and the second HVS-perceivable security patterns are based on simultaneous color contrast, wherein each security pattern includes adjacent first and second objects of contrasting colors, where the first objects of the first and second security patterns have the same color and the second objects of the first and second security patterns have different colors to increase simultaneous color contrast effects and to create an illusion that the first objects have different colors; and an anti-scan pattern applied on the surface of the article, wherein the anti-scan pattern is not perceivable by the HVS.

7. The article of claim 6, wherein the security patterns are human visual system (HVS) security patterns.

8. The article of claim 6, wherein foreground features of the security patterns are smaller than 3.5 mm.

9. The article of claim 6, wherein the security patterns are spaced apart on the surface of the article.

10. The article of claim 6, wherein more than two security patterns are on the surface of the article.

11. The article of claim 6, wherein the first security pattern including adjacent first and second objects and the second security pattern including adjacent first and second objects, wherein the security patterns are on different sides of the article.

* * * * *